US005343803A

United States Patent [19]

Duchek et al.

[11] Patent Number: 5,343,803

[45] Date of Patent: Sep. 6, 1994

[54] METHOD AND APPARATUS FOR DIRECT CONTACT PRINTING SCREENS ON CRT FACEPLATES

[75] Inventors: Richard J. Duchek, Schaumburg; Paul Strauss, Chicago, both of Ill.

[73] Assignee: Zenith Electronics Corporation, Glenview, Ill.

[21] Appl. No.: 24,004

[22] Filed: Feb. 26, 1993

Related U.S. Application Data

[63] Continuation-in-part of Ser. No. 654,843, Feb. 13, 1991.

[51] Int. Cl.[5] ..... B41F 3/36; B41L 1/10; B41L 1/34

[52] U.S. Cl. ..... 101/35; 101/158; 101/170

[58] Field of Search ..... 101/35, 36, 150, 154, 101/158, 269, 250, 251, 252, 256, 282, 159, 160, 161, 162, 170, 485, 486

[56] References Cited

U.S. PATENT DOCUMENTS 4,209,551 6/1980 Masaki et al. ..... 101/150

*Primary Examiner*—J. Reed Fisher
*Attorney, Agent, or Firm*—Roland W. Norris

[57] ABSTRACT

Direct contact printing methods and apparatuses are disclosed for applying screen elements to cathode ray tube (CRT) faceplates. A black-surround, or grille, is first applied to the faceplate, followed by deposition of light-emissive phosphors thereon. Means for repeatable positioning of the screen elements on the faceplate, means for registration of the screen elements with each other, and means for maintaining screen element shape and size are also disclosed. Effective pivot axes for the collector are arranged to lie in the plane of the printing substrates.

9 Claims, 6 Drawing Sheets

METHOD AND APPARATUS FOR DIRECT CONTACT PRINTING SCREENS ON CRT FACEPLATES

CROSS REFERENCE TO RELATED APPLICATIONS

This application is a continuation-in-part of application Ser. No. 07/654,843 filed Feb. 13, 1991, commonly owned herewith.

BACKGROUND OF THE INVENTION

1. Field of The Invention

The present invention relates to apparatuses and methods for applying screens to cathode ray tube (CRT) or other video display faceplates. More particularly the present invention relates to direct contact printing of screens on CRT or other video display faceplates.

2. Discussion of the Related Art

As is known in the art of making color CRT screens, the interior of the glass faceplate, or screening surface, is coated with a black grille, also called a masking or surround, which forms a pattern of uncovered screen areas which are transparent, and surrounding areas which are opaque. Red-light-emissive, green-light-emissive, and blue -light-emissive phosphors are deposited over the black grille to form colored-light emitting areas of known dimension. Together this black grille and the phosphors comprise the basic screen, or image producing area of the CRT. The black grille, being laid down first and thereby determining the areas of light transmission of the screen, is thus critical to the imaging performance of the CRT. The technique of laying down the grille first allows greater tolerance in the phosphor dot or line placement as well as greater screen brightness and/or increased contrast.

Also, as is known, the screen pattern must be placed in registry with a shadow mask which determines the electron beam landing areas used to excite the light-emissive phosphors. "Registry" or "registration" as used herein will refer to the proper placement of elements of the CRT as necessary for the designed functioning thereof. As used herein the term "printing", as in "printing a screen", will refer generally to any kind of screen element deposition on to the faceplate. "Direct contact" or "contact" printing will refer to printing where a surface containing the screen elements, or their precursors such as tacky dots or the like, actually contacts the faceplate screening surface. "Offset" printing will refer to printing wherein the screen element or precursor will be transferred to an intermediate surface before transfer to the faceplate.

As an example, a current 14 inch (diagonal measure) CRT screen of the high-resolution type, commonly used as a computer monitor, has over $880\times10^3$ triads of red, green, and blue light-emissive phosphor dots, each triad corresponding to one hole in the shadow mask. Thus there are about $2.6\times10^6$ individual phosphor dots, at a pitch, or center to center, spacing of about 0.28 mm. Current manufacturing tolerances require tenths of a mil (one mil =0.001 inch) accuracy in phosphor deposition from the nominal dot position to accord adequate registry with the shadow mask.

Current manufacturing technique for screening, i.e. placing the screen elements, of the faceplate utilizes a shadow mask and screen mated-pair, wherein an individual shadow mask is used to serially photoexpose a chemically sensitized slurry coating on the screen area to form the grille and each of the three phosphor patterns. This process is described in U.S. Pat. No. 3,973,964 issued to Howard G. Lange and owned by the assignee hereof. Also described in the Lange patent, and in commonly owned U.S. Pat. No. 4,902,257, is a non-mated method of photoexposure screening denominated as "near contact" printing which may be utilized as part of, or in conjunction with, the present invention. While this photochemical screening process is now highly refined and accurate, it is also lengthy in time and resource intensive, requiring great expenditure of floor space, machinery, labor, and materials such as the expensive phosphor compounds and water needed for the repeated washing of the screen during the process. The disadvantages of the mated screen and mask approach are well known, as is the desire for a useful system of interchangeable screens and masks.

A method of screening the faceplate which obviates some of the difficulties associated with the above-described photochemical screening process involves the use of a "silk screening" process whereby phosphor pastes are forced through apertures of a cloth or wire mesh onto the faceplate to form the screen. This method is described in U.S. Pat. No. 2,625,734, issued to Law; and U.S. Pat. No. 4,248,947, to Oikawa, which discloses the possibility of silk screening phosphors over a previously optically produced grille.

However, even with all process variables optimized in the silk screening process, each phosphor type must still be serially applied to the faceplate, thus slowing manufacturing throughput and adding to the expense of the CRT.

Great Britain Patent No. 2,052,148 issued to Sony Corporation suggests that a flat faceplate panel having no projections thereon may be printed by (silk) "screen printing or other printing processes" including a first optical deposition of the grille followed by subsequent printing of the phosphors. The Sony reference, however, does not teach the use or desirability of direct-contact printing, or any means therefore. The Sony reference is drawn to a flat faceplate having guide grooves for a shadow mask frame assembly therein, and more nearly states a desired result or use of this faceplate, and not a printing method or apparatus.

To obviate the need for separate application of the grille and each phosphor type onto the faceplate it has been proposed, as in U.S. Pat. Nos. 4,549,928 and 4,557,798 issued to Blanding et al., to print each screen element, i.e. grille and red, green, and blue light-emissive phosphors, onto the faceplate in one pass as a contiguous composite film by contact with a common elastomeric collector roller onto which the screen elements are placed in the form of tacky ink-compositions. However, in such a "one-pass" operation, the grille can no longer be used as an opaque substrate for the phosphors. Further, due to the difference in grille-ink and phosphor ink compositions, transfer of the contiguous-sheet screen elements is problematic.

Particularly, by laying down a black-grille, or mask, in the same layering height proportion as the phosphor elements in order to achieve a continuous composite film on the collector for one pass application to the faceplate two problems arise. First, the black grille can no longer be used as an opaque substrate beneath the phosphors to define and limit the boundaries of the phosphor "windows" in the faceplate. Therefore, tolerances must be held exceedingly close under the disclosed method. Second, due to the differences in the particulate composition of the grille and of the phosphors the optimal grille ink dot height is different from that of the optimal phosphor-dot thickness. Thus, the surface of a continuous composite film which is presented to subsequent transfer rollers and ultimately, the faceplate, is compounded of different height dots, which can make transfer problematic. If more grille-ink is used than necessary to equalize dot height, distortions in the grille pattern may occur during subsequent heating operations necessary for CRT manufacture, such as runout of the grille or "ink", i.e. separation of the grille from the phosphor leading to an undesired transparent "window" in the faceplate surrounding the phosphor elements.

Also, due to the close tolerances required in modern high-resolution CRT screens, positional accuracy of the screen elements, most notably the grille, is exceedingly important. Thus, the number of surface-to-surface transfers of the screen element ink-patterns is an important consideration in developing relatively economical and highly accurate screen printing equipment. However, a one pass application of all screen elements in the form of thermoplastic inks, as disclosed in the Blanding, et al. patents, necessarily requires double-offset printing apparatus, thereby increasing the number of surface-to-surface transfers.

The prior art, as evidenced by: U.S. Pat. Nos. 2,625,734; 3,973,964; 4,248,947; 4,549,928; 4,557,798; and GB Patent No. 2,052,148; has recognized the desirability of a screen-printing method which obviates the mated-mask, photoexposure method. However it is believed that several key considerations of screen printing remain unaddressed, including suitable methods and apparatuses which retain all the advantages of the black-grille screen element and which provide accurate and economical phosphor deposition thereon, and eliminate the need for extraneous mask and/or screen hardware such as may be accomplished through use of the flat tension mask technology developed by the assignee hereof.

OBJECTS OF THE INVENTION

It is therefore an object of the present invention to provide improved methods and apparatus suitable for screening CRT faceplates for use in an interchangeable mask and screen system with increased efficiency and cost savings over the present screen printing methods.

It is also an object of the present invention to retain all present advantages of the known grille and phosphor screen element arrangements wherein the grille is applied first to the faceplate and acts as an opaque substrate defining the subsequent screen areas of phosphor emissivity.

It is also an object of the present invention to provide methods and apparatus for use with flat faceplate CRTs having shadow mask mounting rails placed on the screening surface of the faceplate in order to maintain and improve the manufacture of such CRTs.

Other attendant advantages will be more readily appreciated as the same becomes better understood by reference to the following detailed description and considered in connection with the accompanying drawings in which like reference numerals designate like parts throughout the figures.

| BRIEF INDEX OF REFERENCE NUMERALS | |
|---|---|
| 11 | screen printing apparatus |
| 13 | collector |
| 14 | elastomeric blanket |
| 15 | collector frame |
| 17 | support arms |
| 18 | collector indexing means |
| 19 | cliche |
| 20 | screening surface |
| 21 | faceplate, or panel |
| 22 | mask rails |
| 23 | kinematic support |
| 25 | collector axis |
| 27 | cross bar |
| 29 | pneumatic cylinder |
| 31 | collector frame aperture |
| 33 | main frame |
| 35 | pivot points |
| 37 | main frame aperture |
| 39 | collector rails |
| 41 | main frame indexing means |
| 43 | doctor blade assembly |
| 45 | doctor blade |
| 47 | cliche frame |
| 49 | cliche rails |
| 50 | cliche indexing means |
| 51 | plate positioning means |
| 53 | heater plate |
| 55 | conformable support |
| 57 | conformable support pins |
| 59 | undersurface of faceplate |
| 60 | print assembly |
| 61 | rotary cliche |
| 63 | ink supplies |
| 65 | transfer roller |
| 67 | shaft rotary encoder |
| 69 | gear train |
| 71 | motor |
| 73 | collector sensing means |
| 75 | central controller |
| 77 | panel position sensing means |
| 79 | panel motor drive control |
| 81 | panel motive means |
| 83 | speed matching means |
| 85 | linear encoder |
| 87 | stepper motor |
| 89 | positioning jig |
| 90 | slide |
| 91 | base |
| 92 | screw |
| 93 | panel positioner |
| 94 | screws |
| 95 | panel side edges |
| 97 | vertical stops |
| 99 | ball positioners |
| 101 | V grooves |
| 103 | 1st rotary-to-flat printer |
| 105 | 2nd rotary-to-flat printer |
| 107 | near-contact printing apparatus |
| 109 | holding fixture |
| 111 | lighthouse |
| 113 | photoresist |
| 115 | exposure master |
| 117 | ultraviolet light source |
| 119 | light rays |
| 121 | shader plate |
| 123 | lens |

DESCRIPTION OF PREFERRED EMBODIMENTS

Figure 1:
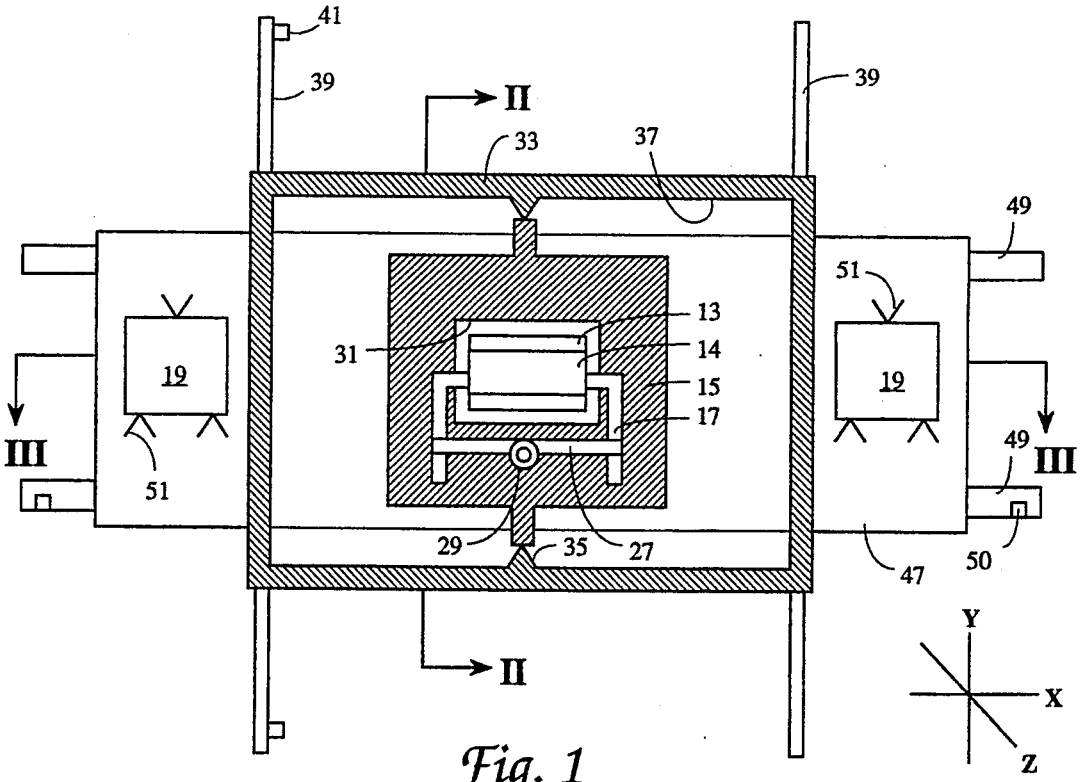
FIG. 1 is a top plan of the first preferred embodiment of FIG. 1.

A workable high-resolution CRT system, utilizing flat screens has been developed. These flat screens present unique opportunities to eliminate the mated-mask approach to CRT formation, with consequent increase in manufacturing throughput and reduced manufacturing costs. By utilizing a flat screen area of the faceplate, grille and phosphor deposition may be accomplished using refined contact printing methods to achieve the required accuracy of screen deposition and eliminate a host of screening problems associated with the current methods.

Registry or registration of the phosphor dots with the grille, i.e. correct positioning of the screen elements; and the integrity of each screen element shape and placement; requires attention to a variety of control means therefor, including, but not limited to: positioning of all printing material, or ink, and transfer contact surfaces; constancy of the apparatus drive means; and matching of the various movements of the print means and faceplate whether the movements are linear or angular, or a combination thereof.

Positional terms as used herein include X, Y, and Z axes. These axes represent screen placement in the finished CRT as normally positioned, with X being the horizontal, Y the vertical, and Z being orthogonal down the depth of the tube. Other terms such as top, bottom, left, right, underneath, etc. are to be taken in their ordinary sense as derived from the accompanying drawing figures.

As seen in FIGS. 1–4, a first preferred embodiment of a screen printing apparatus 11 comprises a collector roller 13 of cylindrical shape rotatably mounted on opposite sides thereof to a collector frame 15 by support arms 17. The collector 13 is covered with a elastomeric blanket 14 which is the collector contact surface for distributing pressure-sensitive, thermoplastic, tacky ink or other types of screen element associated patterns from a cliche 19 to a faceplate 21, or panel, having a screening surface 20, as further explained below. The inks contain the screen elements, i.e. the particulates of either the phosphors or the black-grille material, which constitute the viewing area of the CRT.

Although illustrated as a cylinder, it is envisioned that the collector 13 could be a plate of predetermined curvature corresponding to the curvature of the CRT screening surface. Therefore, the term "collector" will be taken in its broad sense to mean the final ink pattern transfer surface which contacts the faceplate. The term "cliche" will be taken in its broad sense to mean the original screen element associated pattern-defining surface whether it be a gravure, a raised surface, or other variation thereof. It will be understood that either the cliche or collector, or both, may be suitably formed as plates or cylinders according to the present invention unless otherwise specified.

The grille or phosphor "associated pattern" will be understood to include that pattern of printed substances normally deposited by the printing processes herein described. The pattern will, of course, correspond to a screen element matrix. The printed substances may include: carbon or phosphor containing thermoplastic compounds denominated as "inks" for direct deposition of the desired screen element onto the faceplate, or other substances precedent to final screen element deposition such as selectively removable compounds, and sticky substances which anchor screen elements onto the faceplate.

Figure 4:
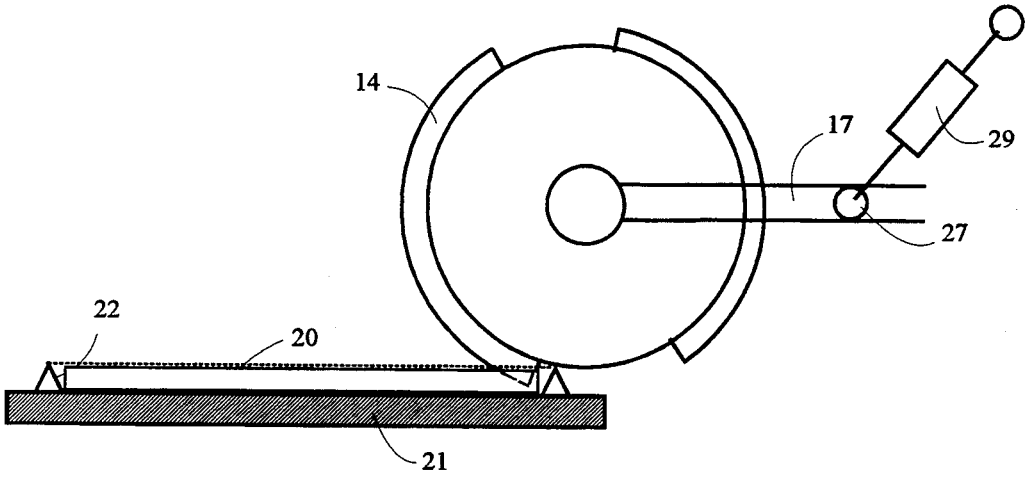
FIG. 4 is a side view illustrating a collector roller for printing on a flat faceplate with the tension mask support rails attached thereto.

As seen in FIG. 4, the elastomeric blanket 14 may extend from the collector roller 13 to allow the collector roller 13 to clear the mask mounting rails 22 located on the faceplate 21. Alternatively, there may be openings formed in the surface of the collector roller 13 to provide the necessary clearance. It will be understood that in contact printing a faceplate 21 with rails 22 attached thereto, a shadow mask may be attached to the rails 22 and over the screen immediately after screening, thereby eliminating any extraneous mask mounting/carrying hardware.

In the embodiment of FIGS. 1–4 the collector roller 13 moves over both a flat cliche 19 which creates the screen element ink pattern, and a flat CRT faceplate 21, both of which are placed in predetermined, i.e. determinately fixed, locations during collector contact. While the preferred embodiment illustrates the use of a flat faceplate, say planar to within 0.3 mils, it is envisioned that faceplates having a predetermined curvature of finite radius may also be utilized. Reproducibility of the printed ink pattern upon the panel 21 is ensured in part because the collector roller 13 movement is suitably controlled by roller and thrust bearings (not shown) located on the collector to minimize bearing-drag and inertial forces which would otherwise contribute to unevenly printed and, therefore, out of tolerance screens. This is especially important, as noted, in the grille deposition. Positional stability of the collector 13 within the support arms 17 is ensured by the aforementioned bearings as well as kinematic support means 23, which register and maintain the interchangeable collector roller 13 within the support arms 17. The support means 23 is diagramatically disclosed in FIG. 2 as interlocking members contained on both the collector axis 25 and the support arms 17. The collector 13 may be removed from the arms 17 as desired and replaced with a doctor blade assembly 43 as further explained below.

Collector registry means 18, such as mechanical stops are provided on the collector 13 for determinitively positioning a consistent starting point of collector motion. The support arms 17 are interconnected by a crossbar 27 and each arm is pivotally connected to the collector frame 15 so that they, and the attached collector 13, may be moved through the Z axis, i.e., up or down, by application of force to the cross bar 27. A means for applying this Z-axis force is e.g. a pneumatic cylinder 29. The pneumatic cylinder 29 is affixed to the cross bar 27 to thereby move the collector 13 above its printing position, i.e. out of contact with cliche 19 or faceplate 21, and also to control the pressure of the collector 13 against the cliche 19 or faceplate 21 when the collector 13 is in the printing position, as further explained below.

The collector frame 15 is a rigid mounting structure for the collector 13 with an aperture 31 therethrough which allows the elastomeric blanket 14 of the collector 13 to subtend the collector frame 15 when in the printing position. The collector frame 15 is pivotally mounted at pivot points 35 to a main frame 33 so as to allow rotation of the collector longitudinal axis about its midpoint in the x axis, into the collector plane of contact with the cliche 19 or faceplate 21. This allows the collector surface to conform to a cliche 19 or faceplate 21 whose surface may be canted or angled in this axis, thus ensuring uniform collector-to-faceplate force distribution and contact.

The main frame 33 is a rigid mounting structure with an aperture 37 therein into which the collector frame 15 is pivotally mounted as described above. The main frame 33 is slideably mounted on collector rails 39 or sine bars, so as to allow for highly accurate translational movement of the main frame. Main frame registry means 41 are provided on the collector rails 39 for precise positioning of main frame 33 travel. The main frame indexing means 41 are illustrated as stops but could alternatively be a gear train arrangement or an indexed and controlled drive shaft depending on the level of apparatus sophistication desired. The main frame registry means 41 preferably works in conjunction with the collector registry means 18 to provide precise control of the stop and start points of the angular travel of the elastomeric blanket 14 during the printing of screen elements onto the faceplate 21, to ensure reproducibility of the printed faceplates.

Figure 2:
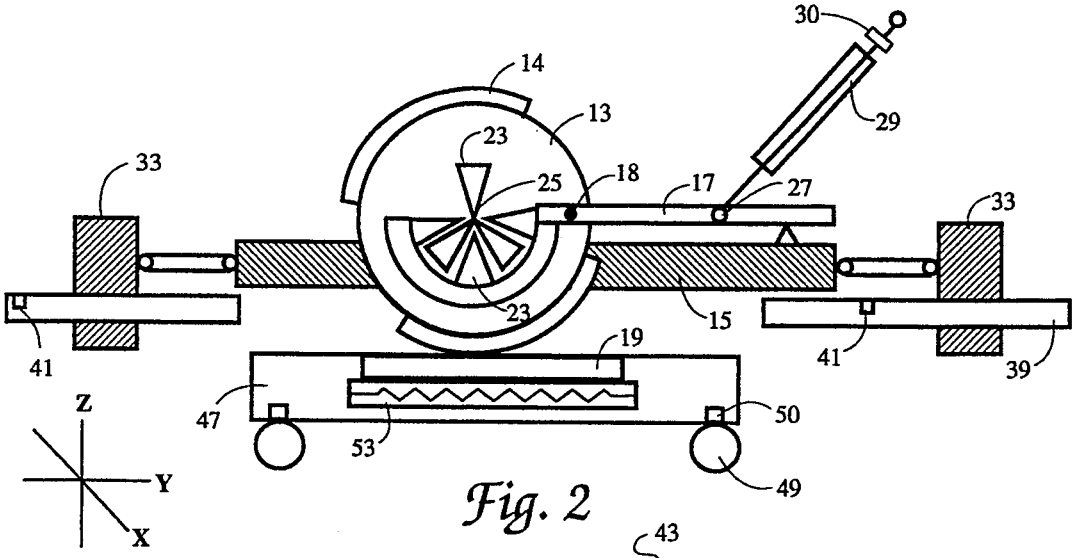
FIG. 2 is a side view in partial cross section taken a long line II—II in FIG. 1 of a first preferred embodiment of the present invention.
Figure 2A:
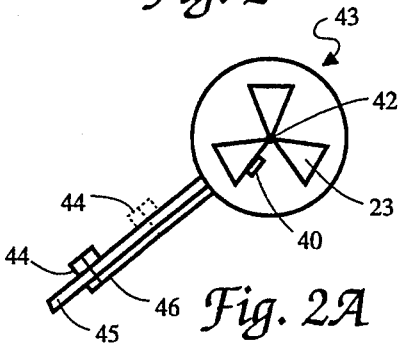
FIG. 2A is a side view of a doctor blade assembly for use with the embodiment of FIG. 1.

As seen in FIG. 2A, a doctor blade assembly 43 is provided so as to be interchangeable with the collector 13 in the support arms 17. A doctor blade 45 provided within the doctor blade assembly 43 is used to remove excess ink from the cliche 19 when the cliche 19 is of the gravure type, as further explained below. The doctor blade 45 is mounted on a face plate 46, which supports the flexible doctor blade. A top clamp 44 is attachable over the doctor blade 45 to the base plate 46 at various positions along the length of the doctor blade 45 to vary the flexibility of the doctor blade in order to provide for slight adjustments in blade flexure and responsiveness. As seen in FIG. 2A, top clamp 44 may be placed to shorten the effective length of the doctor blade 45 to make it less flexible, as shown in solid lines, or placed to lengthen the effective length of the doctor blade 45 to make it more flexible, as shown in phantom. The doctor blade angle of incidence to the cliche 19 is set initially at the pivot point of the doctor blade assembly central axis 42 by mechanical stops 40 or the like. The force with which the doctor blade 45 contacts the cliche 19, and the degree of doctor blade flexure resulting therefrom, is controlled by the pneumatic cylinder 29 pressing on the cross bar 27. Because the doctor blade 45 will typically require much less contact force on the cliche 19 than is used for the collector roller 13, a means 30 for limiting the travel of the pneumatic cylinder 29 is used where the pneumatic cylinder does not have the range of force control required to adequately operate both the collector roller 13 and the doctor blade assembly 43. Limiting means 30 will preferably be an adjustable mechanism such as a micrometer stop or the like. Alternatively, a frame structure substantially duplicative of that for the collector 13 could be provided for the doctor blade assembly 43.

Figure 2B:
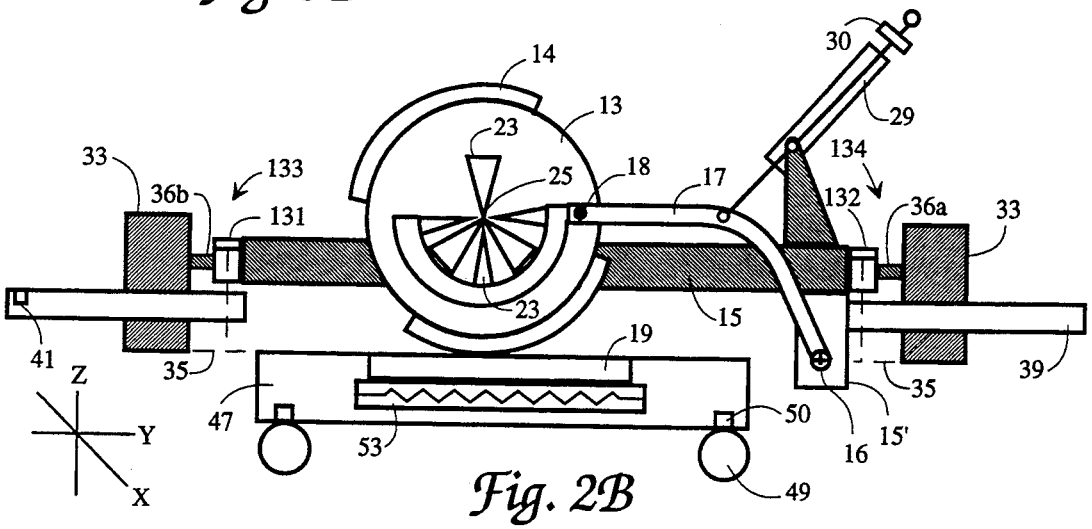
FIG. 2B illustrates a preferred embodiment of the apparatus of FIG. 2 wherein the collector frame pivot axis and collector support arm pivot axis are placed in the plane of the substrates.

As seen in FIG. 2B, the collector support arm up and down pivots 16 and the collector frame effective pivot axis 35 are located in the plane of the cliche and panel substrates resulting in the pivotal motions of the collector during the printing process being normal to the X-Y plane of the printing substrates ensuring equalized print pressure for good image uniformity and also eliminating the chance of scrubbing motion at the collector to substrate interface.

The support arm pivots 16 are kinematically supported through a ball receiving cone socket and a ball receiving "V" groove socket, these sockets being located on collector frame extensions 15' extending into the plane of the substrate, e.g. cliche 19, but outside the physical boundaries thereof, as necessary. The collector frame roll axis 35 is placed in the substrate plane by mounting arc segments 131, 132 whose center of curvature lies in substrate plane, on the collector frame 15. Bearings 36*a*, 36*b* attached to the main frame 33 support the arc segments 131, 132 to allow pivoting with the effective pivot or roll axis being in the plane of the substrate. Alternatively, the main frame 33 and collector frame 15 may be suitably sized and placed so as to allow the actual pivot structure to be placed in the substrate plane.

Figure 9:
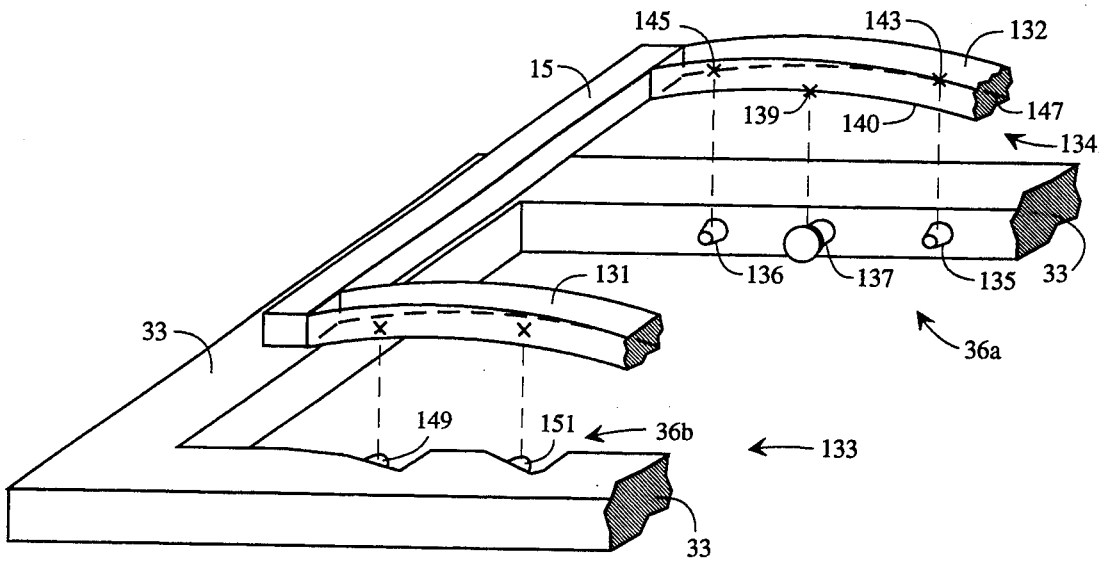
FIG. 9 illustrates a five point kinematic collector frame pivotal mounting remote from the substrate plane, but whose effective roll axis is in the substrate plane.
Figure 9A:
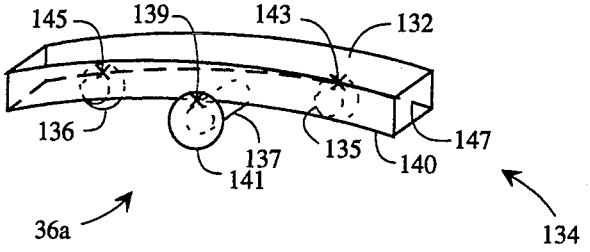
FIG. 9A and 9B are detail views of FIG. 9.
Figure 9B:
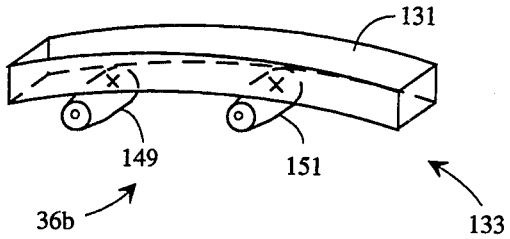

As seen in FIGS. 9 & 9A, the collector frame pivot mechanisms 133, 134 are constructed to create a five contact point kinematic carriage frame support system. The support system uniquely locates the collector frame 15 within the main frame 33 while allowing the collector frame 15 one degree of freedom, i.e., its pivotal motion. The carriage frame support system is composed of the two arc segments 131, 132 and their associated bearing assemblies 36*a*, 36*b*. The arc segments and bearing assemblies although shown to be mounted on the collector frame 15 and main frame 33 respectively, may be reversed. A first bearing assembly 36a preferably, but not necessarily, comprises two cone shaped 135, 136 and one "trumpet bell" shaped 137 roller bearings. The centrally located trumpet-bell bearing 137 is constructed and arranged to have its point of contact 139 with the arc segment 132 on the arc segment and on a first side 140 thereof. The conical "bell" 141 of the trumpet has an apex facing the main frame 33 while the apex of each cone shaped bearing 136, 135 faces the collector frame. The cone-shaped bearings contact the arc segment at lower points 143, 145 and on a second side 147 thereof.

On the opposite side of the main frame 33, are mounted two barrel-shaped bearings 149, 151 each constructed and arranged to establish one point contact with the mating arc segment located on the opposing side of the collector frame 15. Thus, a unique placement of the collector frame 15 is established within the main frame 33 by the five points of contact between the roller bearings 135, 136, 137, 149, 151 and the arc segments 131, 132. A modification of this five point placement system is also suitably useful for the kinematic support 23 of the collector 13 by substituting axle bearings on the roller for the arc segments and locating the five point bearings in the collector support arms 17.

A cliche frame 47 providing a rigid mounting structure for the cliches 19 and the faceplate 21 is located beneath the main frame 33. The cliche frame 47 is slideably mounted on cliche rails 49, or sine bars, so as to allow translatory movement of the cliche frame 47 perpendicular to the axis of movement of the collector frame 15. Alternatively, the orientation of the cliche frame 47 and its movement could be parallel to that of the collector frame 15.

Cliche registry means 50, such as previously described for the main frame, are provided to determinitively position the cliche frame 47 to ensure proper placement of the cliche or faceplate contact surfaces beneath the collector 13.

Plate positioning means 51 are located on the cliche frame 47 to provide for precise location and orientation of the cliche and faceplate contact surfaces, i.e., those surfaces contacting the collector, with respect to both the cliche frame 47 and the collector 13. These plate positioning means 51 may consist of three contact point positioners, such as are known in the art, in combination with micrometer adjustment screws (not shown) for ultrafine positioning if necessary. A plate positioning jig, such as described hereinafter in conjunction with FIG. 6, may be used to control cliche and/or faceplate position in all directions and planes.

It will be appreciated that the number of cliches 19 may be varied herein, as dictated by the requirements of the printing process. For instance, should the screen printing apparatus 11 be used only for separate application of the grille, then only one cliche for the grille pattern, would be required.

A heater plate 53 is located in the cliche frame 47 beneath each cliche 19 in order to keep the thermoplastic ink contained therein at or above its melting point if thermoplastic inks are used in order to establish the screen element associated pattern. A conformable support 55, such as is more completely described in the afore-cited cross referenced related application, is located beneath the faceplate 21 to prevent the faceplate from deforming under rolling/printing pressure applied when the collector 13 contacts the faceplate 21. The conformable support 55 is preferably a plurality of pins 57 which are applied to contact the undersurface 59 of the faceplate 21 without force thereon and then locked into this contact position mechanically, hydraulically or the like, to provide a support bed which conforms to the shape of the faceplate. Conformable supports may also be located under the cliches 19 if necessary.

In operation, the cliche 19, or cliches, containing the desired screen element pattern, and the faceplate 21, are aligned and attached to the cliche frame 47. The desired cliche 19, preferably although not necessarily, of the gravure type is then supplied with a thermoplastic, tacky, screen element ink. Gravure cliches are preferred due to their ink dot dispersing accuracy and low wastage of screen materials. After the cliche 19 is supplied with ink, the doctor blade assembly 43 is drawn over the cliche 19 to remove all excess ink. The excess ink is then returned to a reservoir for reuse. The cliche frame 47 is then moved to place the inked cliche 19 in a fixed, predetermined position of registration beneath the collector 13 if this has not yet been done. The collector 13 is indexed to its starting point and brought to bear on the cliche 19 with the required pressure. The main frame 33 is then moved to roll the collector 13 over the cliche contact surface by means of frictional contact, whereupon the proper ink pattern is distributed onto the elastomeric blanket 14. Because the screen element pattern is placed upon the collector 13 with frictional contact, the preferred collector roller 13 is made of a low inertia material such as aluminum, or the like, to aid in an even rolling motion of the collector.

The collector 13 is then raised out of contact with the cliche 19 and reindexed if necessary. The faceplate 21 is then moved into position beneath the collector 13, whereupon the collector is lowered into contact therewith and rolled over the faceplate, transferring the ink pattern to the surface thereof.

It will be appreciated that substances other than those inks which directly carry screen elements may be deposited by the contact printing apparatus described herein. For example, tacky dots may be contact printed onto the faceplate, and dusted with the appropriate phosphors in the known manner, so as to form the screen. Also a selectively removable substance, such as the known PVA-ADC photoresist, might be applied hereby as an element in grille formation, as further described below. Therefore, the pattern transferred by the printing apparatus to form the CRT screen may be broadly described as a screen element associated pattern.

Only one screen element associated pattern transfer has been described operationally because, as stated previously, the most critical screen printing operation is the initial printing of the grille. However, it will be appreciated that successive patterns of the three different phosphor inks may be transferred serially to the faceplate, after application of the grille, with successive collector-to-faceplate contacts through attendant movements of the cliche frame 47.

Figure 3:
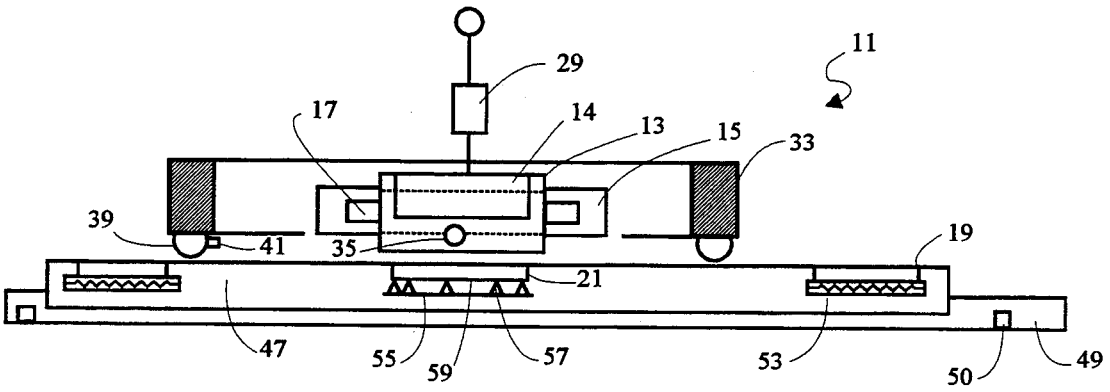
FIG. 3 is an elevation of the first preferred embodiment taken along line III—III of FIG. 1.

It will be appreciated that the embodiment of FIGS. 1–3 is a single offset printing apparatus wherein the ink, e.g. grille ink, is transferred intermediately between its supply, the cliche 19, and its target, the faceplate 21, only once. This single offset arrangement minimizes the printing apparatus and processing variables which could lead to out-of-tolerance screen printing.

Figure 5:
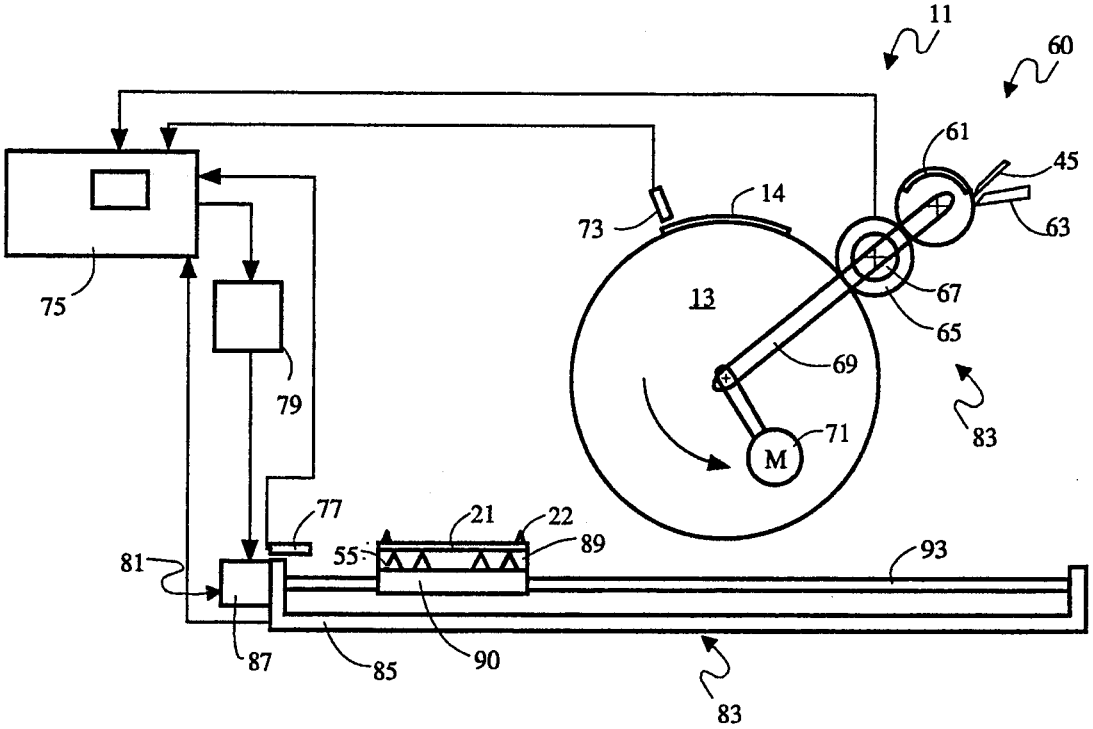
FIG. 5 is a side view of a second preferred embodiment of the present invention.

As seen in FIG. 5, a second embodiment of the screen printing apparatus 11 may be characterized as a rotary cliche 61-to-flat faceplate 21, double-offset, gear-driven, apparatus used particularly for printing of the phosphor inks in one pass onto the faceplate 21. It will be appreciated that double or other multiple type offset print apparatus may be utilized in each ink transfer assembly 60.

The rotary cliches 61, one for each phosphor type, are supplied with individual ink supplies 63 and doctor blades 45 necessary for continuous operation. As each ink transfer assembly 60 is similar, only one will be described. Each roller 61, 65, 13, in the ink transfer assembly 60 may be seen as a transferring roller whose function is to transfer the predetermined screen element ink pattern to another surface. Abutting the cliche roller 61 is a transfer roller 65 for receiving the ink pattern from the cliche 61, with the ink solidifying and becoming tacky as it cools on the transfer roller 65. This transfer of the ink pattern is a critical step in creating a screen of proper length on the faceplate 21 because the angular movement of the cliche and transfer rollers 61, 65, respectively, must be such that the ink pattern transferred covers a linear distance over the face of the transfer roller 65 within tolerance to the ultimately desired screen length. Due to the exceptionally tight tolerances required for CRT screen printing, a rotary encoder 67 is located at the transfer roller 65 to determine its tangential velocity. Alternatively, the rotary encoder 67 could be placed on the rotary cliche 61. This tangential velocity information is input to a controller 79 acting on the panel motive means 81, as further explained below.

The transfer roller 65 abuts the collector 13, which is typically a roller of larger diameter than the transfer rollers 65, enabling the several transfer rollers 65 to abut the collector roller 13 simultaneously, thereby to transfer and register each phosphor ink pattern into a single screen pattern thereon.

A gear train 69 comprised of antibacklash gears (not shown) coupled to a motor 71, interconnects and drives the cliche-to-transfer roller-to-collector assembly so as to remove possible fluctuations of angular movement.

Grille-to-phosphor registration errors may occur if the faceplate 21 position is not precisely matched to the print pattern position contained upon the elastomeric blanket 14 at the start of contact between the two. This is especially true where, as seen in FIG. 5 the elastomeric blanket 14 must clear the mask rails 22 at close intervals. Therefore, panel position sensing means 77 are provided for orienting the panel 21 with respect to collector 13. Collector position sensing means 73 are also provided on the collector 13 or elastomeric blanket 14. The panel position sensing means 77 and collector position sensing means 73 may include magnetic or electro-optic transducers coupled to the central controller 75, which in turn is connected to a panel motor drive control 79 which controls panel motive means 81, as further explained below.

Translational-to-tangential velocity matching means 83 are further included to precisely match the linear velocity of the panel 21 to the tangential velocity of the collector 13 to ensure screen element integrity and prevent distortion of screen print pattern deposition caused by any differences between movements of the collector 13 and faceplate 21. A speed mismatch during ink deposition onto the panel 21 may cause a host of problems including: elongation of screen length and smearing of the phosphor dot shapes, misregistration of dots and grille, etc. thereby leading to screen/mask misregistration and degradation of final image quality in the CRT. The velocity matching means 83 is comprised of a rotary encoder 67 on the transfer roller 65, and a linear encoder 85 located beneath the panel motive means 81. Both encoders 67,85 input data to the central controller 75, which in turn adjusts the speed of the panel, or faceplate 21, by outputting control signals to the motor drive control 79 which in turn pulses a stepper motor 87 driving the face plate 21. The faceplate 21 is preferably mounted to a positioning jig 89 which in turn is mounted to slide 90, which is driven on a screw 92 attached to the stepper motor 87. Thus the linear motion of the faceplate 21 will be corrected to match the rotary motion of the pattern transferring rollers i.e., cliche roller 13, transfer roller 65, cliche roller 61, by the velocity matching means 83, which may be considered as a form of "electronic gearing" to match the faceplate and print roller speeds.

Figure 6:
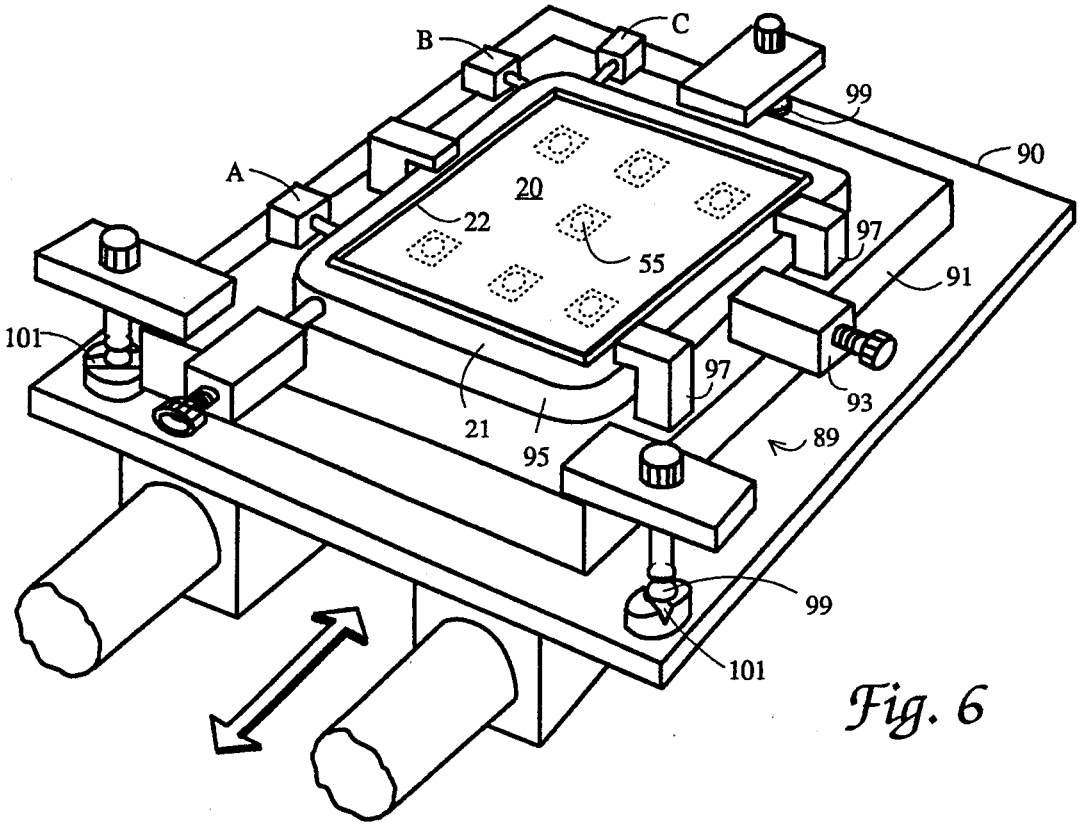
FIG. 6 is a perspective view of a positioning jig for faceplates when using the apparatus of the present invention.
Figure 6A:
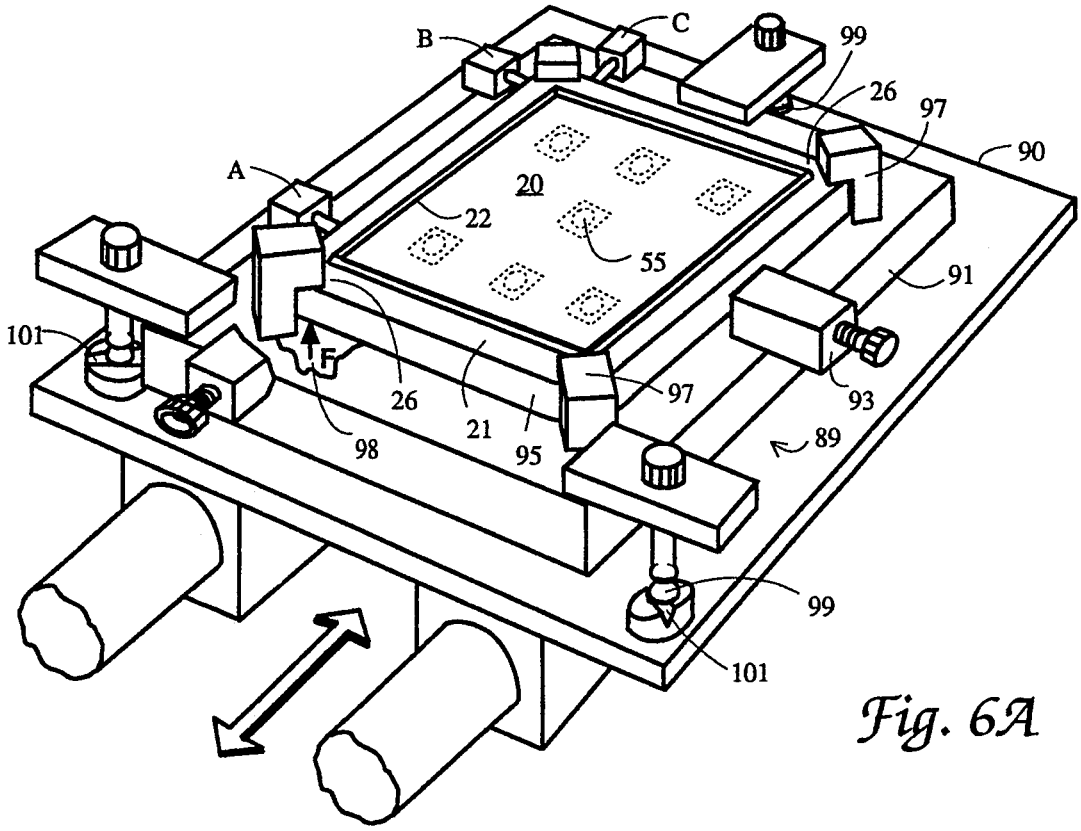
FIG. 6A is an alternative embodiment of FIG. 6.

As seen in FIG. 6, the positioning jig 89 comprises a base 91 into which the faceplate 21 is set, and positioned horizontally against three reference stops A,B,C by panel positioners 93, shown as screws 94 mounted on the base 91 for contacting the panel side edges 95. Vertical stops 97 attached to the base 91 contact the screening surface of the faceplate 21 to prevent motion thereof upwardly, while conformal supports 55 attached to the base 91 lie beneath the faceplate 21 to prevent panel deformation under printing pressure, as explained in connection with the first embodiment. As seen in FIG. 6A, in addition to conformal support, a vertical stop 97 may be located at each panel corner 26. The panel 21 is then conformed at its corners to the reference plane defined by the vertical stops 97 by force means 98 such as screws, springs, or the like, before fitting the conformal supports 55. If further panel planarity is required the reference plane may be extended substantially around the periphery of panel 21 and force applied as dictated by the curvature of the panel. Three ball- positioners 99 are located on the underside of the base 91 contacting V-grooves 101 located on the slide 90 for orienting the positioning jig 89 thereon. By maintaining orientation of the faceplate 21 in all planes the positioning jig 89 ensures proper presentation of the faceplate 21 to the collector roller 13. Also, the positioning jig 89 may be found useful for constant presentation of the faceplate 21 during other manufacturing processes thereon.

Figure 7:
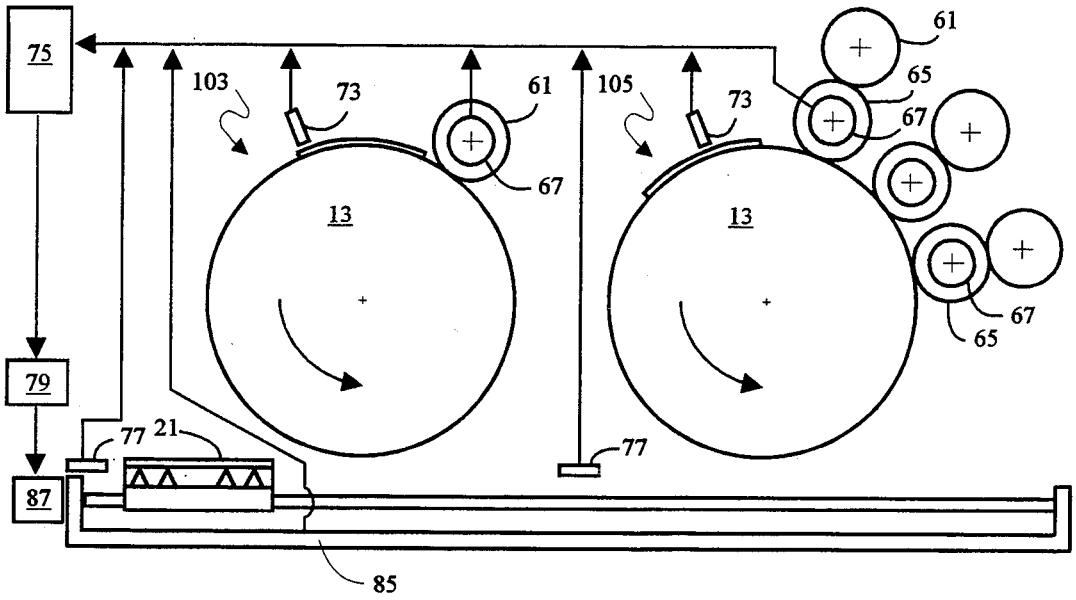
FIG. 7 illustrates a "two-tower" apparatus for serial deposition of the grille and the phosphors.

In use, the printing apparatuses 11 described are presented with a faceplate 21 which is to be initially printed with a grille over which the phosphor dots are printed. For example, the embodiment of FIG. 1 may be used to precisely lay down the grille, while the embodiment of FIG. 5 may be used to deposit the phosphors thereon in a single application. Alternatively, a "two-tower" apparatus approach, such as illustrated in FIG. 7 may utilize a first rotary-to-flat printer tower 103 for grille application and a second rotary-to-flat printer tower 105 for phosphor application, to screen the faceplate 21 in serial fashion. Aforedescribed means for registering screen element-to-panel positions and means for matching rotary speeds of the pattern transferring rollers to the linear speed of the faceplate are, of course, provided.

Also alternatively, the faceplate 21 may be "pre-grilled" i.e., have the grille initially deposited, by a printing process wherein polyvinyl alcohol (PVA) or other removable dots are printed onto the panel screening surface where grille openings are desired, i.e., where later the phosphors are to be deposited. The grille material is then deposited over the PVA dots, and the dots are removed by known processes, leaving a finished grille. This technique may have an advantage in accuracy over "complete grille" printing in that present print techniques are more highly adapted to the deposition of dot matrices than the deposition of a continual grille web with its many interconnected rows and columns of grille ink. This technique, like those previously described, also eliminates any need for traditional photoexposure to form the screen.

However, if the grille deposition control and placement accuracy required are of such a high order that the aforedescribed printing techniques for the grille are not found to be economically achievable, proximity photoexposure printing of the grille, using master artwork to maintain interchangeability of screens, may be used for applying the grille.

Figure 8:
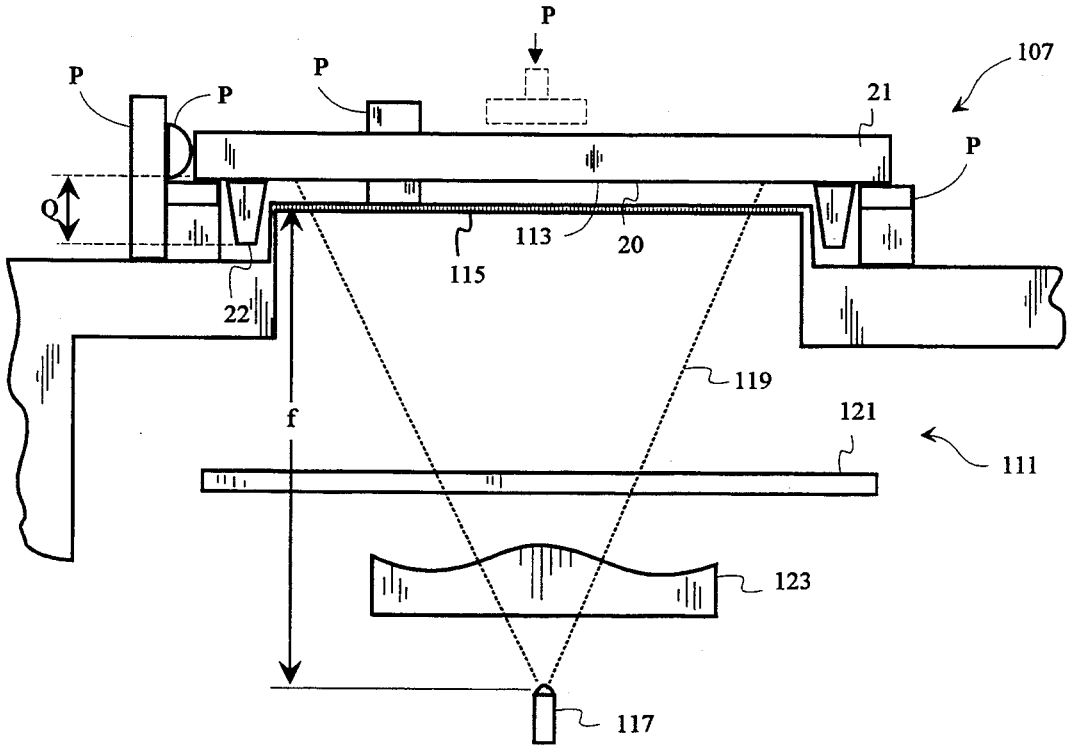
FIG. 8 illustrates a proximity printing exposure apparatus which may be used to apply the grille according to the present invention.

As seen in FIG. 8, a proximity printing apparatus 107 includes a holding fixture 109 having various faceplate positioning elements P and a lighthouse 111 for forming the grille on the faceplate 21. Alternatively, the positioning jig 89 of FIG. 6 may be used to fit into the lighthouse 111 for proper faceplate positioning. The faceplate 21 will have contact printed, or otherwise suitably applied, a layer of light-actinic photoresist 113, such as PVA to the screening surface 20.

Photoexposure master 115 is permanently installed in lighthouse 111 with the image-carrying layer facing upward and spaced in proximity, say 1.5–100 mils and preferably 20 mils, from the screening surface 20 of panel 21. At a fixed distance "f" from the plane of the photoexposure master 115 is placed an ultraviolet light source 117 which emits light rays 119 which simulate the electron beam paths in a completed tube.

A shader plate 121 modifies the light intensity over the surface of the master 115 so as to compensate for the variation of distance from the light source and for the variation of the angle of incidence, thereby achieving the desired exposure in all regions. Lens 123 provides for correction of the paths of the light rays 119 so as to simulate more perfectly the trajectories of the electron beams during tube operation.

Experience has indicated that screen patterns produced by following the procedures just described are sufficiently accurate for use in high resolution tubes, provided that the Q height of mask rails 22 measured from the screening surface 20 to the machine ground top surface of the mask rails 22 is held to a very close tolerance.

Alternatively, present photoexposure screening equipment and techniques may be utilized to apply the grille before phosphor deposition, while still yielding savings over the current mated-mask and screen photoexposure method.

While the present invention has been illustrated and described in connection with the preferred embodiments, it is not to be limited to the particular structure shown, because many variations thereof will be evident to one skilled in the art and are intended to be encompassed in the present invention as set forth in the following claims.

Having thus described the invention, what is claimed is:

1. An apparatus for the application of color display screens to display device panels, comprising:

a) a main frame defining an aperture sized to admit a collector frame;

b) a collector frame sized to fit within the main frame aperture and pivotably connected to the main frame so as to pivot substantially about an axis parallel to the plane of a printing substrate, the collector frame also defining an aperture;

c) a collector sized to fit within the collector frame aperture and pivotably connected to the collector frame so as to pivot substantially about an axis parallel to the plane of a printing substrate and perpendicular to the pivot axis of the collector frame.

2. The apparatus of claim 1 further comprising:

a) means for causing relative motion between the main frame and the printing substrate;

b) means for causing contact between the collector and the printing substrate, whereby, during the contact between the collector and the printing substrate, a surface of the collector is able to conform to the substrate surface even if it is angled or canted, thereby insuring uniform transfer pressure across the collector.

3. The apparatus of claim 1 further defined by having effective pivot axes of the collector frame and the collector lying in the plane of the printing substrate.

4. The apparatus of claim 3 wherein a pivot mechanism between the collector frame and the main frame is physically remote from the plane of the printing substrate.

5. The apparatus of claim 1 wherein the collector frame is uniquely and pivotally located within the mainframe by a support system having five points of contact between the mainframe and the collector frame thereby allowing the collector frame only one degree of freedom, that being pivotal, relative to the mainframe.

6. The apparatus of claim 4 wherein the collector frame is uniquely and pivotally located within the mainframe by a support system having five points of contact between the mainframe and the collector frame thereby allowing the collector frame only one degree of freedom, that being pivotal, relative to the mainframe.

7. In a method of offset printing a color display screen from a gravure plate onto a substantially rigid display panel with a cylindrical transfer roller, the improvement comprising;

conforming the surface of the transfer roller to the surface of the gravure plate during image pickup therefrom, and conforming the surface of the transfer roller to the surface of the display panel during image deposition thereon, by allowing the cylindrical transfer roller to pivot side to side, and up and down during pick up and deposition, so as to equalize the transfer pressure between the transfer roller and each of the gravure plate and panel, during their respective periods of contact, so as to compensate for any wedging in placement of the gravure plate or display panel and thereby insure uniform deposition of the display screen image onto the display panel.

8. The method of claim 7 further comprising:

allowing the side-to-side and the said up and down pivoting to have effective pivot axes in the planes of the gravure plate and display panel thereby to prevent scrubbing during image transfer.

9. A method of ensuring image uniformity during gravure printing of video display panels, utilizing a collector to transfer the image, comprising:

a) supplying a main frame defining an aperture sized to admit a collector frame;

b) supplying a collection frame sized to fit within the main frame aperture and pivotably connected to the main frame so as to pivot substantially about an axis parallel to the plane of a printing substrate, the collector frame also defining an aperture;

c) supplying a collector sized to fit within the collector frame aperture and pivotably connected to the collector frame so as to pivot substantially about an axis parallel to the plane of a printing substrate and perpendicular to the pivot axis of the collector frame, and d) conforming a collector surface to a substrate surface by pivoting the collector to match a substantially X-Y plane orientation of the substrate surface and by further pivoting the collector to match a substantially Z axis orientation of the substrate surface through use of the apparatus as defined in claim 1.

* * * * *